US011143366B1

(12) United States Patent
Lin

(10) Patent No.: US 11,143,366 B1
(45) Date of Patent: Oct. 12, 2021

(54) LED RING LAMP STRUCTURE

(71) Applicant: Chien-Ting Lin, Santa Fe Springs, CA (US)

(72) Inventor: Chien-Ting Lin, Santa Fe Springs, CA (US)

( * ) Notice: Subject to any disclaimer, the term of this patent is extended or adjusted under 35 U.S.C. 154(b) by 0 days.

(21) Appl. No.: 17/225,039

(22) Filed: Apr. 7, 2021

(30) Foreign Application Priority Data

Apr. 8, 2020 (CN) ..... 202020498499.4

(51) Int. Cl.
*F21S 4/28* (2016.01)
*F21Y 103/33* (2016.01)
*F21Y 115/10* (2016.01)

(52) U.S. Cl.
CPC ..... *F21S 4/28* (2016.01); *F21Y 2103/33* (2016.08); *F21Y 2115/10* (2016.08)

(58) Field of Classification Search
CPC ..... F21S 4/28; F21Y 2103/33; F21Y 2115/10
See application file for complete search history.

(56) References Cited

U.S. PATENT DOCUMENTS 10,041,633 B2 * 8/2018 Li ..... F21K 9/61
10,322,667 B2 * 6/2019 Bennett ..... B60Q 1/0052
2013/0077285 A1 * 3/2013 Isogai ..... F21K 9/238 362/84
2014/0153251 A1 * 6/2014 Yang ..... F21V 7/0008 362/294
2017/0184282 A1 * 6/2017 Chien ..... F21K 9/232
2017/0351127 A1 * 12/2017 Masuda ..... G02F 1/133308
2020/0386371 A1 * 12/2020 Zhu ..... F21K 9/20

FOREIGN PATENT DOCUMENTS

CN 206410005 U * 8/2017

* cited by examiner

*Primary Examiner* — Rajarshi Chakraborty
*Assistant Examiner* — Glenn D Zimmerman
(74) *Attorney, Agent, or Firm* — Lin & Associates IP, Inc.

(57) ABSTRACT

Provided is an LED ring lamp structure, including: an annular base provided with a plurality of bumps and a plurality of grooves radially and alternately arranged on the annular base; and an LED strip light shaped in a long strip, bendable and deformable, and capable of emitting light after being supplied with power. A plurality of LED light emitting portions are evenly disposed on the LED strip light. The plurality of LED light emitting portions are correspondingly arranged on respective bumps, remaining portions of the LED strip light are evenly disposed in respective grooves, and an arrangement of the LED light emitting portions is changed from a linear arrangement to an annular arrangement. The LED light emitting portions are arranged toward a same predetermined direction.

5 Claims, 12 Drawing Sheets

LED RING LAMP STRUCTURE

CROSS-REFERENCE TO RELATED APPLICATION

This application claims the priority of China patent application No. 202020498499.4, filed on Apr. 8, 2020, which is incorporated herewith by reference.

BACKGROUND OF THE INVENTION

1. Field of the Invention

The present invention relates to an LED ring lamp structure, and more particularly, to an LED ring lamp structure in which the arrangement of the light sources is changed from a linear arrangement to an annular arrangement.

2. The Prior Arts

Conventional LED (light emitting diode) ring lamps all use a complete-ring shaped LED lamp substrate. This kind of design results in a large amount of basic loss and material waste. The larger the size of the LED ring lamp is, the more material wastes.

In addition, the conventional LED ring lamps include half-ring shaped or quarter-ring shaped LED lamp substrates. Although they consume less material than the complete-ring shaped LED lamp substrates, they still generate unnecessary waste. Moreover, this kind of design may still cause a higher defect rate due to poor manufacturing and wiring, thereby causing inconvenience to users.

SUMMARY OF THE INVENTION

In order to overcome the problems of material waste and defect rate in the conventional LED ring lamps, the present invention provides an LED ring lamp structure, which utilizes bumps and grooves of an annular base, and changes the arrangement of the light sources from a linear arrangement to an annular arrangement. Therefore, the LED ring lamp structure according to the present invention can maintain the convenience in use and avoid the material waste.

The technical solution adopted by the present invention to solve its technical problem is to provide an LED ring lamp structure, comprising: an annular base including a plurality of bumps and a plurality of grooves radially and alternately arranged on the annular base; and an LED strip light shaped in a long strip, bendable and deformable, and capable of emitting light after being supplied with power. A plurality of LED light emitting portions are evenly disposed on the LED strip light. The plurality of LED light emitting portions are correspondingly arranged on respective bumps, remaining portions of the LED strip light are evenly disposed in respective grooves, and an arrangement of the LED light emitting portions is changed from a linear arrangement to an annular arrangement. The LED light emitting portions are arranged toward a same predetermined direction.

Preferably, the annular base can be a rectangular thin plate having a plurality of trapezoid patterns, and an upper base and a lower base of each of the trapezoid patterns are disposed at both long sides of the rectangular thin plate, respectively. The rectangular thin plate is folded along respective trapezoid patterns to form the plurality of bumps and the plurality of grooves. The rectangular thin plate is connected end-to-end to form as a ring shape, and a total length of an inner edge line of the annular base is equal to a total length of an outer edge line of the annular base.

Preferably, the LED ring lamp structure further comprises an annular rear cover and an annular front cover. The annular front cover allows light transmission, the annular base is disposed in the annular rear cover, and then the annular front cover covers the annular rear cover.

Preferably, the annular rear cover is the annular base.

Preferably, the LED ring lamp structure further comprises a holder connector, which is disposed at an appropriate position of the annular rear cover and is capable of connecting with a holder.

The present invention has the beneficial effect in that the arrangement of the light sources on the LED strip light is changed from a linear arrangement to an annular arrangement, and the light emitting portions are all directing to a same direction. By this kind of design, the material waste can be avoided, and the advantage of converging the light can also be achieved.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Hereinafter, the implementations of the present invention will be described according to FIGS. 1 to 4B. The description is not intended to limit the implementations of the present invention, but is one of the embodiments of the present invention.

Figure 1:
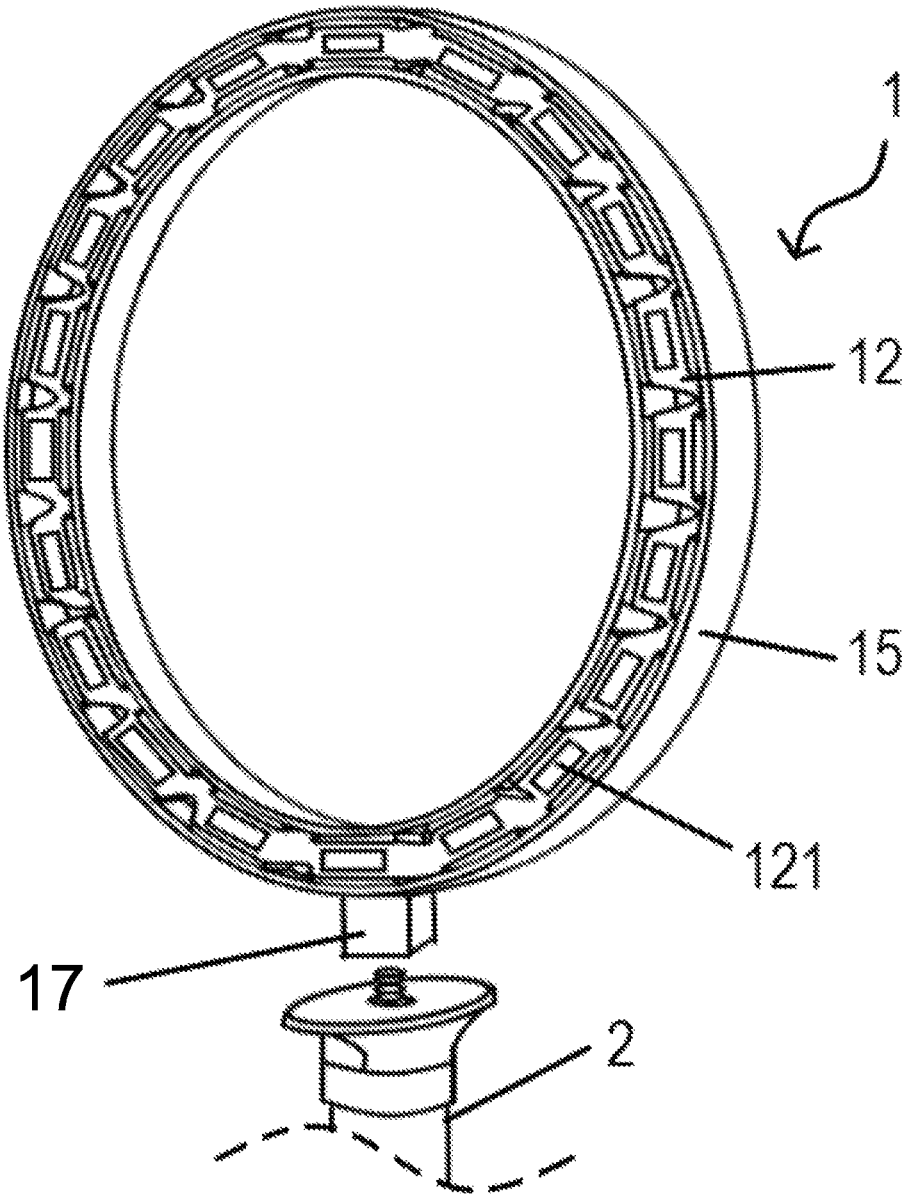
FIG. 1 is a schematic view showing a first embodiment of the present invention.
Figure 2A:
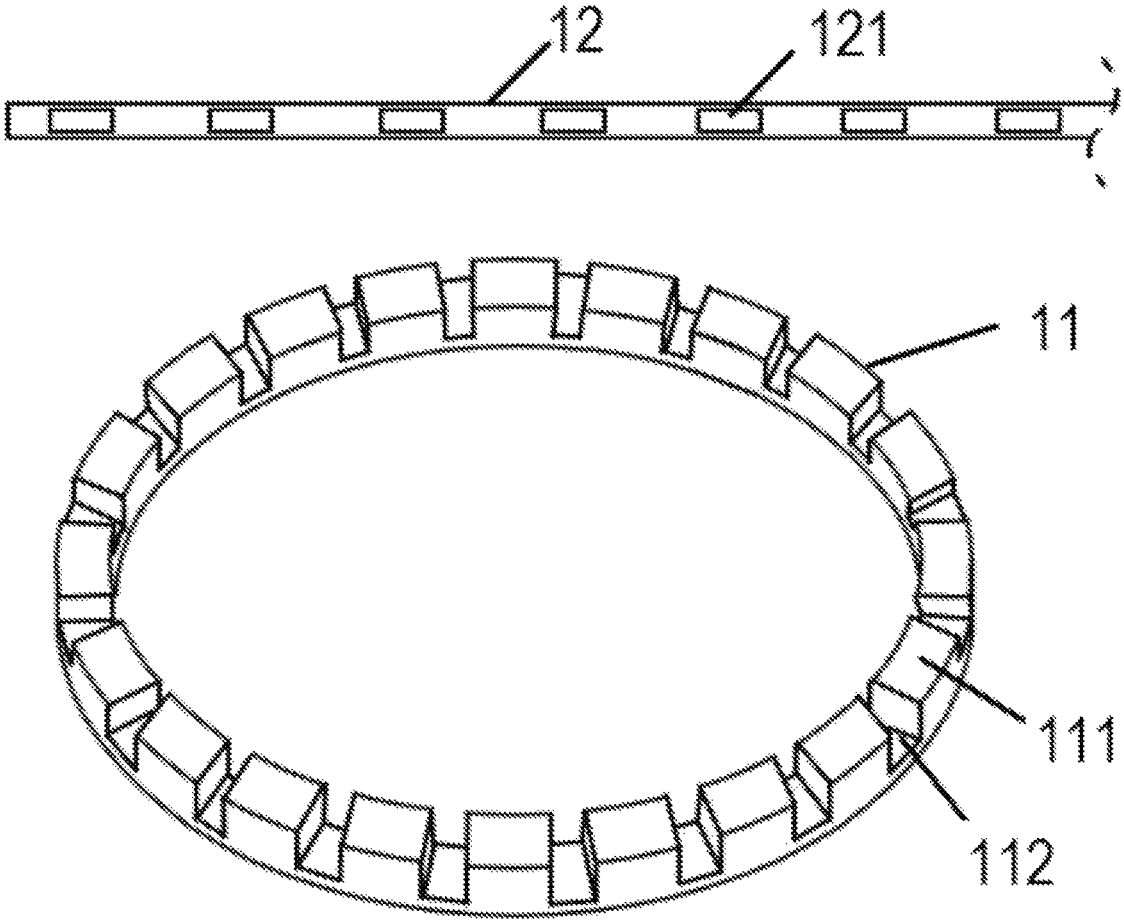
FIG. 2A is a schematic exploded view showing the first embodiment of the present invention.
Figure 2B:
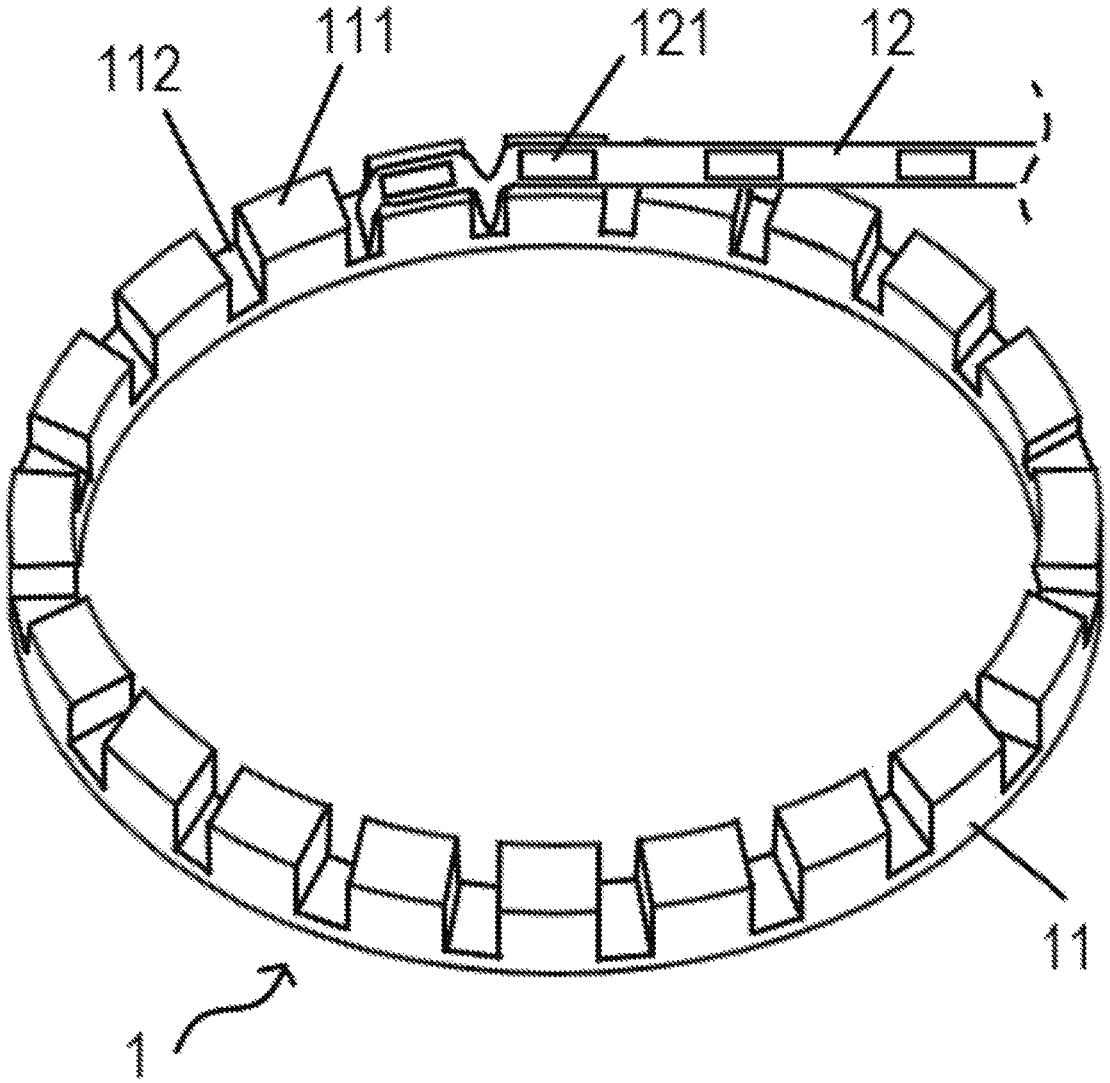
FIG. 2B is a schematic view showing the first embodiment of the present invention during assembly.
Figure 2C:
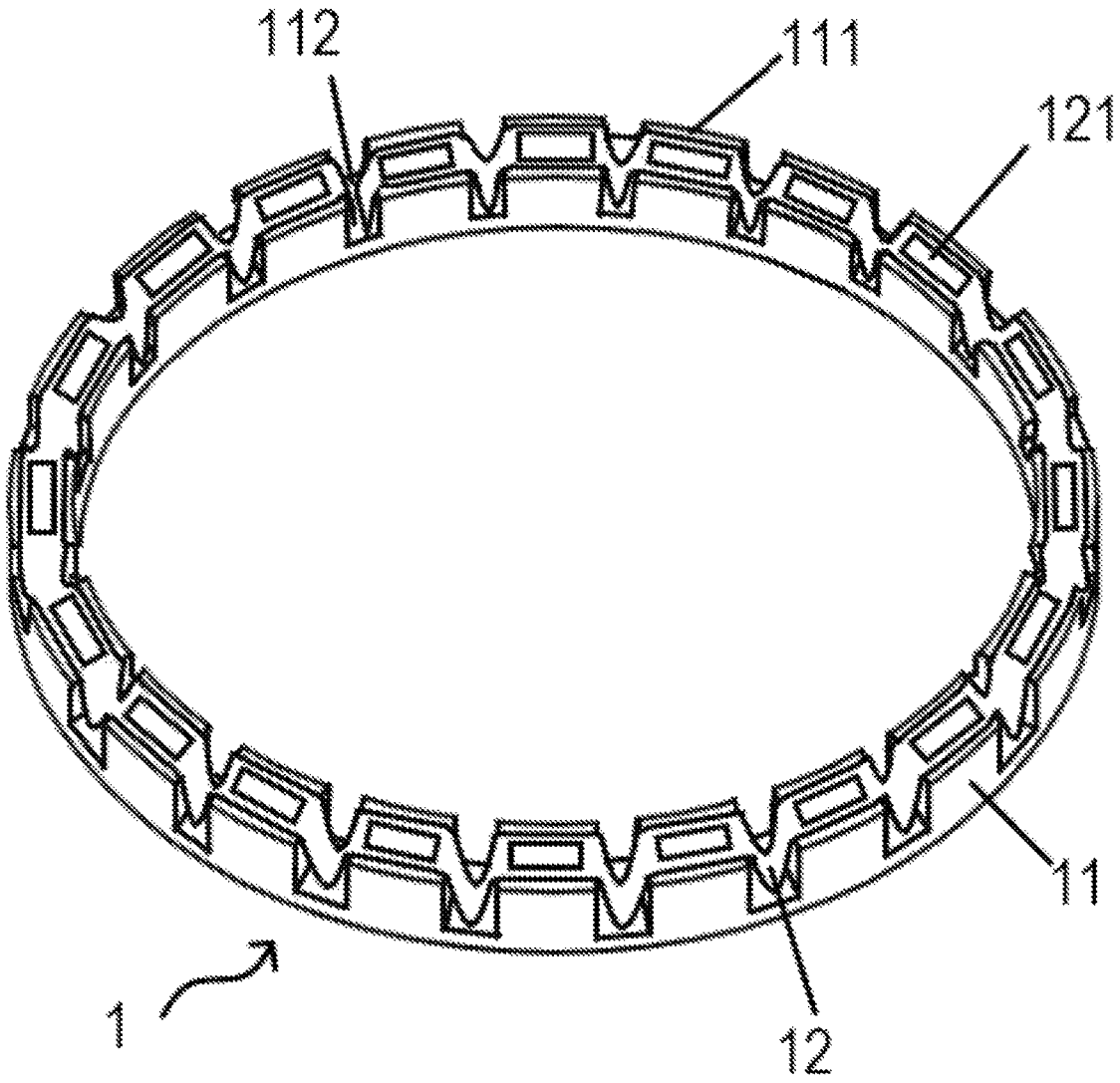
FIG. 2C is a schematic view showing the first embodiment of the present invention after assembly.

Referring to FIGS. 1 to 2C, an LED ring lamp structure 1 according to a first embodiment of the present invention includes an annular base 11 and an LED strip light 12, as shown in FIG. 2A. The annular base 11 is provided with a plurality of bumps 111 and a plurality of grooves 112, which are radially and alternately arranged on the annular base 11. The LED strip light 12 is shaped in a long strip, is bendable and deformable, and is capable of emitting light after being supplied with power. The LED strip light 12 includes a plurality of LED light emitting portions 121 evenly disposed on the LED strip light 12. As shown in FIG. 2B, the plurality of LED light emitting portions 121 are correspondingly arranged on respective bumps 111, and remaining portions of the LED strip light 12 are evenly disposed in respective grooves 112. Thus, an arrangement of the LED light emitting portions 121 is changed from a linear arrangement to an annular arrangement, and the LED light emitting portions 121 are arranged toward a same predetermined direction. According to the present invention, the arrangement of light sources is changed from a linear arrangement to an annular arrangement. Each of the bumps 111 can incline towards the center of the annular base 11 by an appropriate angle, thereby achieving the effect of converging the light of the LED ring lamp structure 1. In addition, the LED light emitting portions 121 can be separate lamp bulbs, or be in a completely connected COB (Chip-On-Board) form.

Figure 3A:
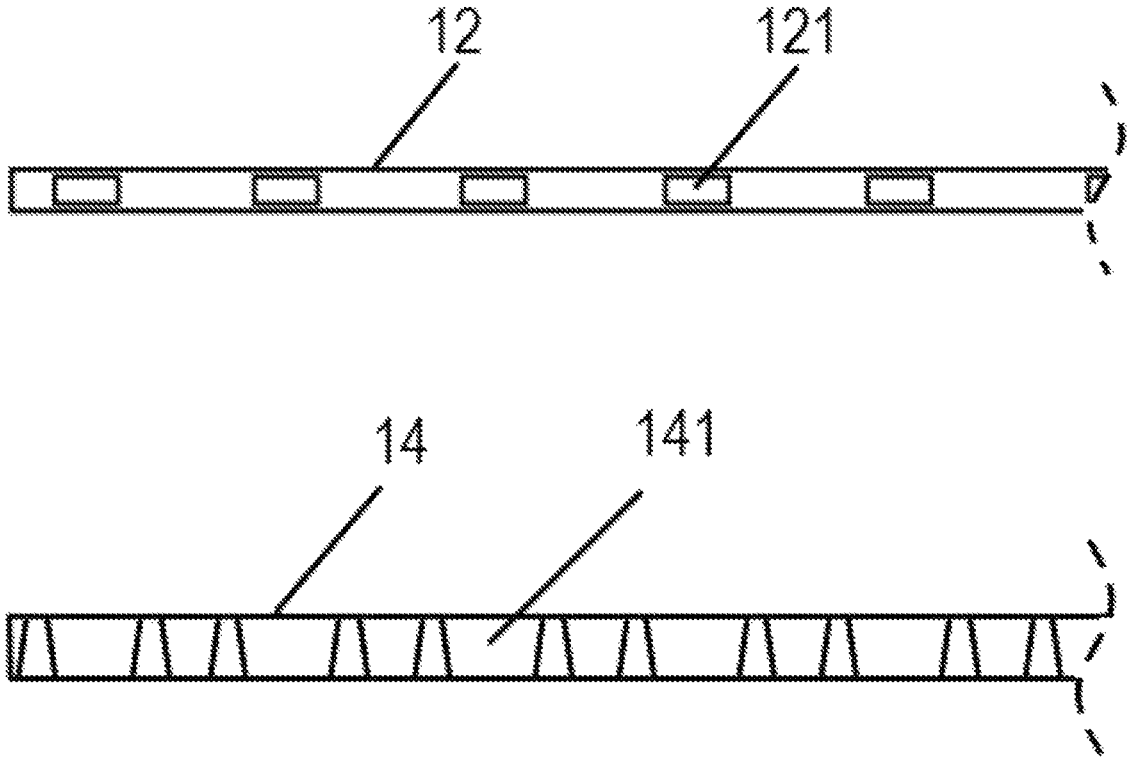
FIG. 3A is a schematic view showing the rectangular thin plate and the LED strip light of a second embodiment of the present invention.
Figure 3B:
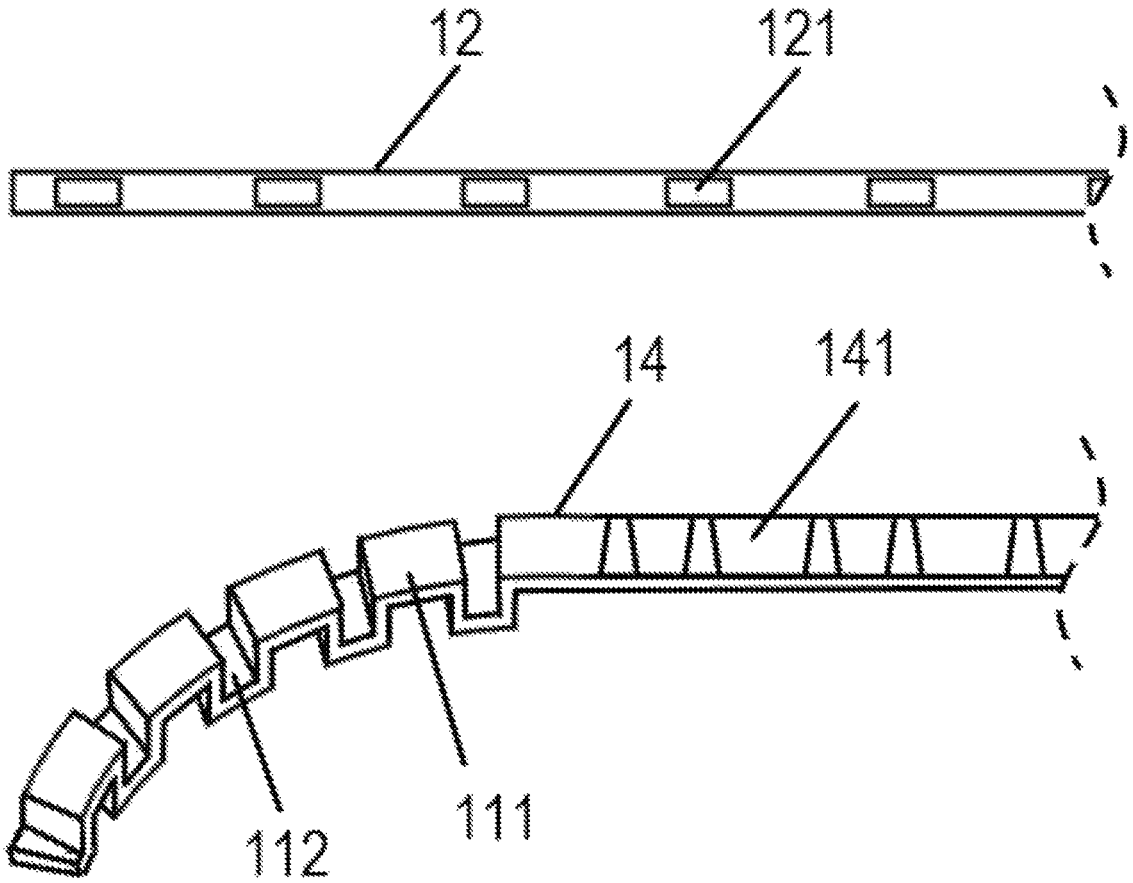
FIG. 3B is a schematic view showing folding the annular base of the second embodiment of the present invention.
Figure 3C:
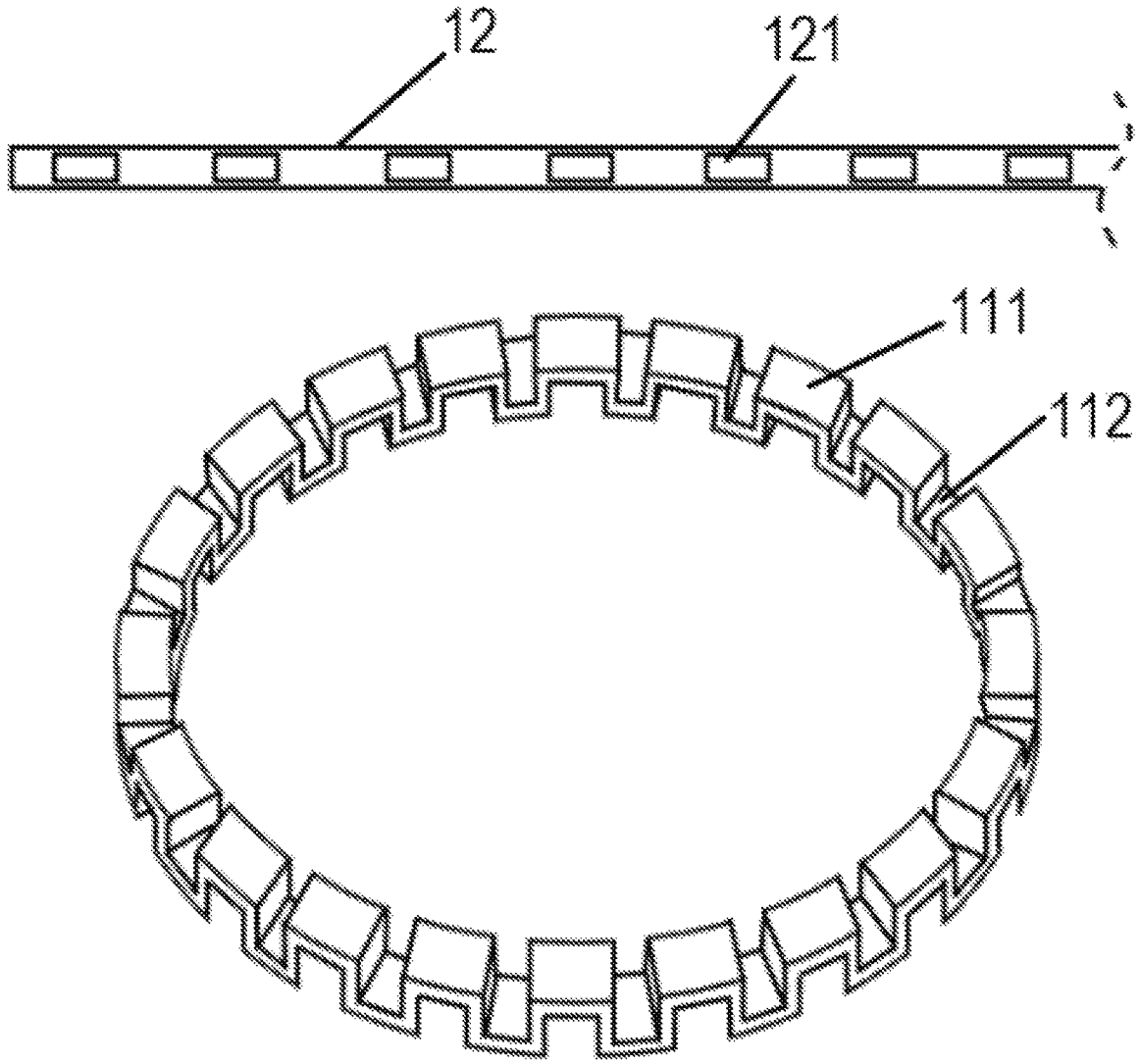
FIG. 3C is a schematic view showing the LED strip light and the annular base of the second embodiment of the present invention, which have not been assembled with each other.
Figure 3D:
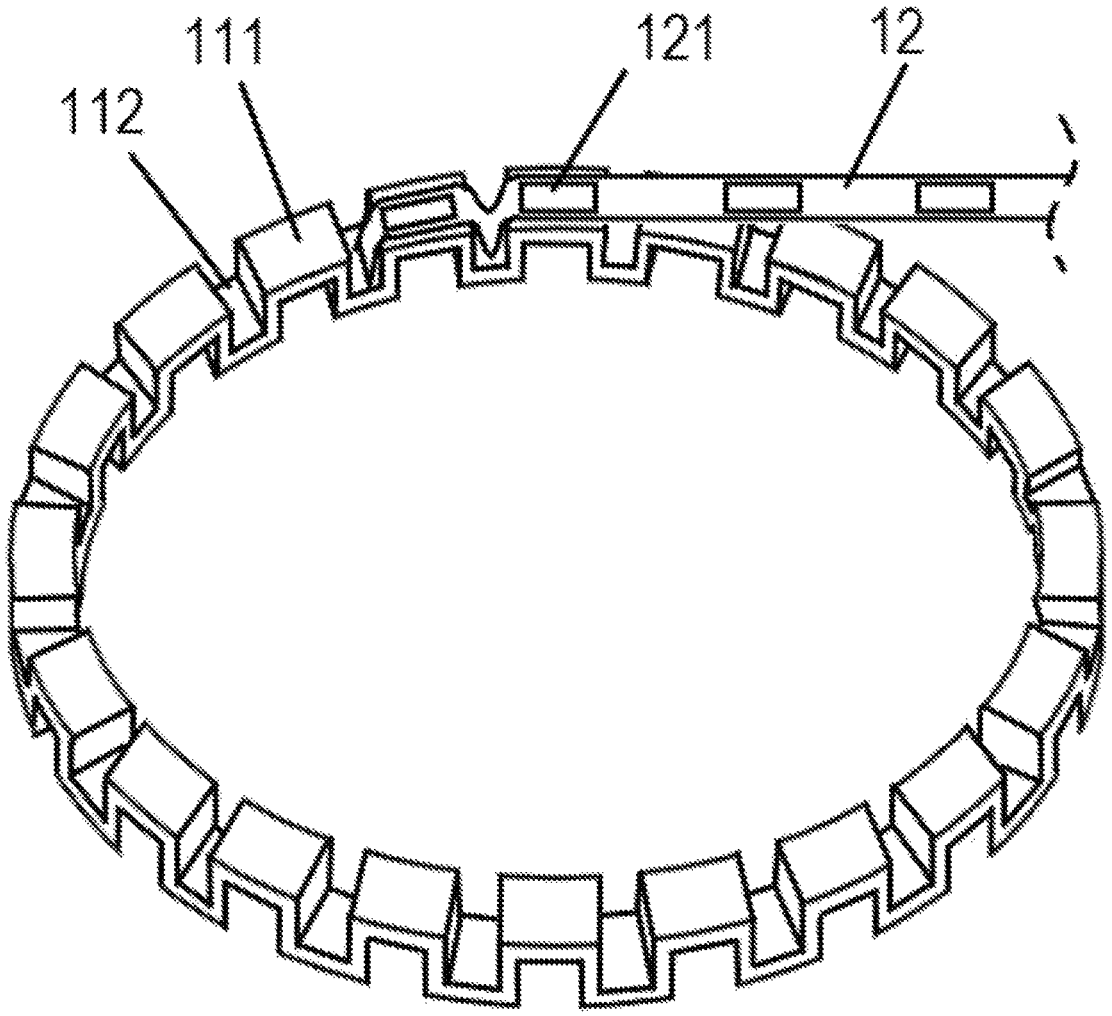
FIG. 3D is a schematic view showing the second embodiment of the present invention during assembly.

FIGS. 3A to 3F show a second embodiment of the present invention. As shown in FIG. 3A, the annular base 11 can be a rectangular thin plate 14 having a plurality of trapezoid patterns 141, and an upper base and a lower base of each of the trapezoid patterns 141 are disposed at both long sides of the rectangular thin plate 14, respectively. As shown in FIG. 3B, the rectangular thin plate 14 is folded along respective trapezoid patterns 141 to form the plurality of bumps 111 and the plurality of grooves 112. As shown in FIG. 3C, the rectangular thin plate 14 is connected end-to-end to form as a ring shape, and a total length of an inner edge line of the annular base 11 is equal to a total length of an outer edge line of the annular base 11. As shown in FIG. 3D, the plurality of LED light emitting portions 121 of the LED strip light 12 are arranged on the plurality of bumps 111, such that the arrangement of the light sources on the LED strip light 12 is changed from a linear arrangement to an annular arrangement.

Figure 3E:
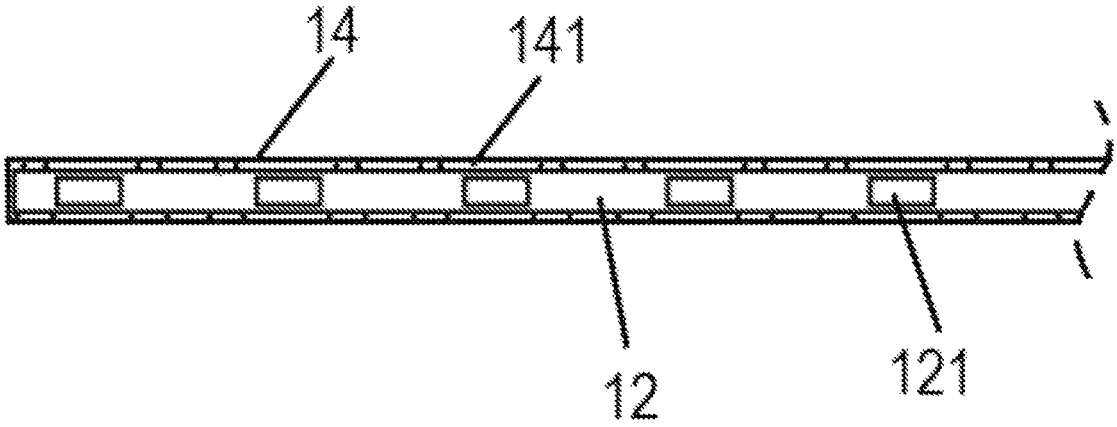
FIG. 3E is a schematic view showing the rectangular thin plate and the LED strip light of the second embodiment of the present invention, which are assembled with each other.
Figure 3F:
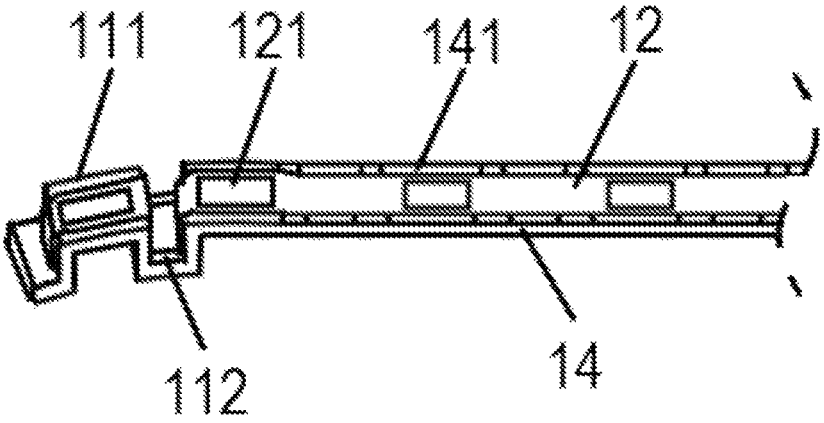
FIG. 3F is a schematic view showing folding the rectangular thin plate and the LED strip light of the second embodiment of the present invention after being assembled with each other.

Preferably, FIGS. 3E and 3F show the second embodiment of the present invention. As shown in FIG. 3E, the length of the LED strip light 12 is the same as that of the rectangular thin plate 14, respective LED light emitting portions 121 corresponds to respective trapezoid patterns 141, and the LED strip light 12 and the rectangular thin plate 14 are assembled with each other correspondingly. As shown in FIG. 3F, the rectangular thin plate 14 is then folded along respective trapezoid patterns 141 to form the plurality of bumps 111 and the plurality of grooves 112. According to the present invention, the rectangular thin plate 14 can have patterns with other shapes, such as triangular patterns, such that each of the grooves 112 of the formed annular base is a slope inclined to the center. Moreover, the rectangular thin plate 14 can have patterns with different shapes and distances, and the rectangular thin plate 14 can be folded to form a loop such as various polygons, ellipses, etc.

Figure 4A:
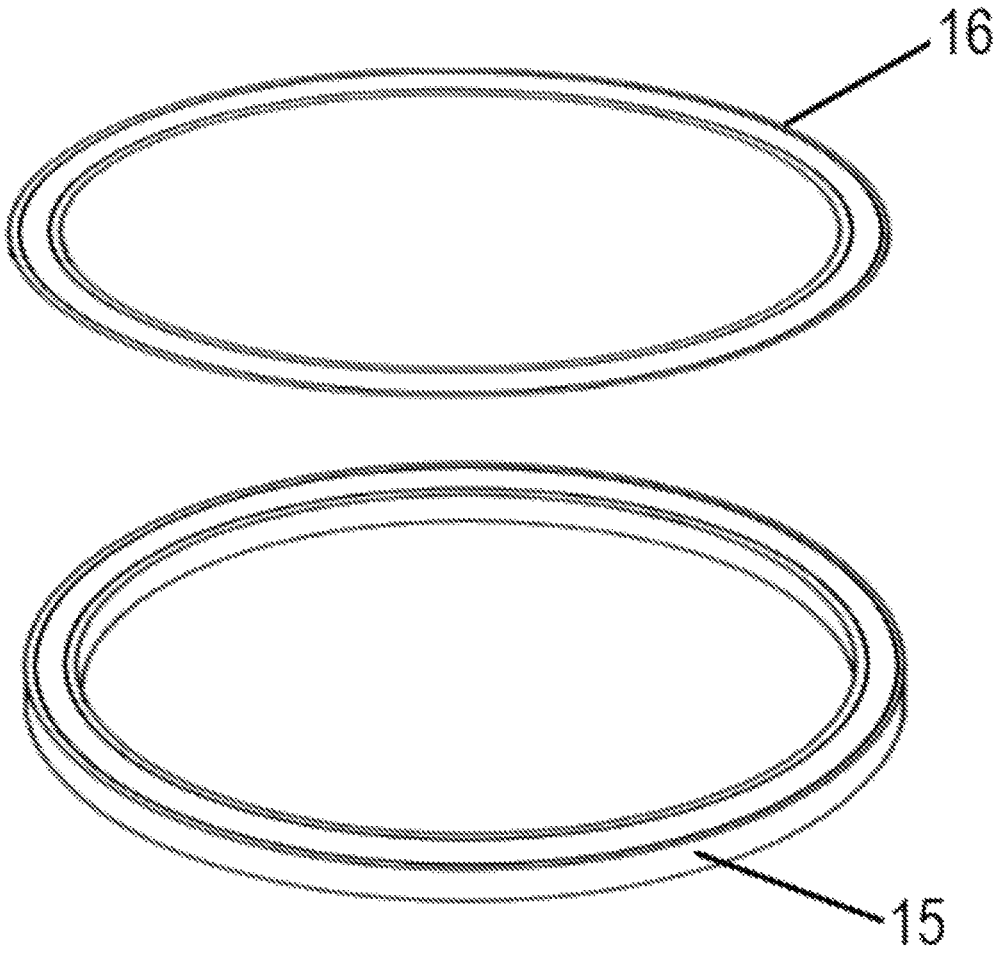
FIG. 4A is a schematic exploded view showing a third embodiment of the present invention.
Figure 4B:
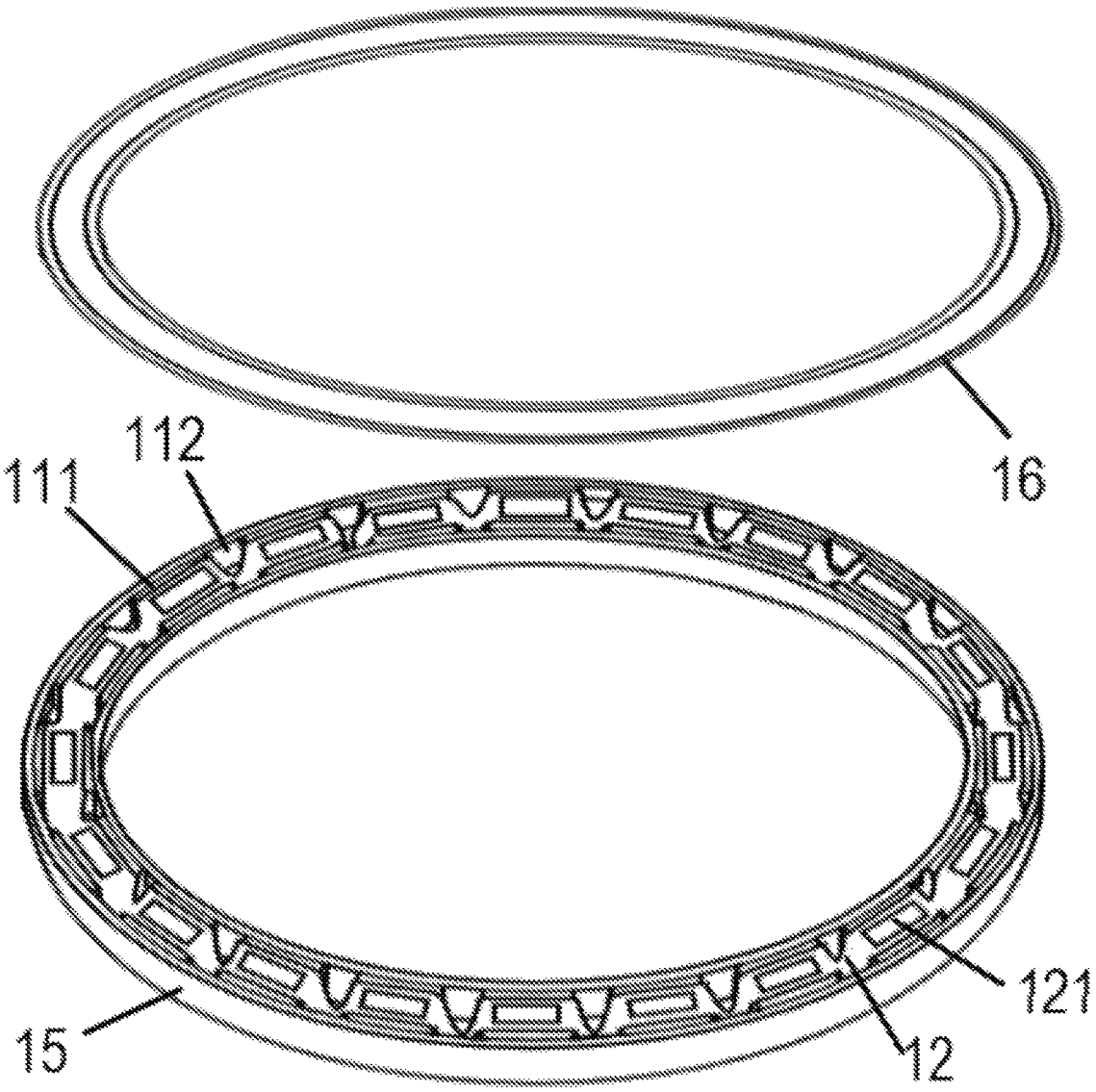
FIG. 4B is a schematic view showing the third embodiment of the present invention in which the annular base is placed in the annular rear cover.

FIGS. 4A and 4B show a third embodiment of the present invention. The LED ring lamp structure 1 further comprises an annular rear cover 15 and an annular front cover 16, and the annular front cover 16 allows light transmission. The annular base 11 is placed in the annular rear cover 15, and then the annular front cover 16 covers the annular rear cover 15. According to this embodiment, the annular rear cover 15 can be directly provided with the plurality of bumps 111 and the plurality of grooves 112, and therefore the annular rear cover 15 is the annular base 11.

Referring to FIG. 1, the LED ring lamp structure 1 according to the first embodiment of the present invention further comprises a holder connector 17. The holder connector 17 is disposed at an appropriate position of the annular rear cover 15 and can be used to connect with a holder 2.

The foregoing descriptions and illustrations are merely explanations for better embodiments of the present invention. Those skilled in the art can make other modifications according to the claimed scope of the accompanying claims and the foregoing descriptions, provided that such modifications are still belong to the inventive spirit of present invention and should fall within the claimed scope of the present invention.

What is claimed is:

1. An LED ring lamp structure, comprising:

an annular base including a plurality of bumps and a plurality of grooves radially and alternately arranged on the annular base; and an LED strip light shaped in a long strip, bendable and deformable, and capable of emitting light after being supplied with power, a plurality of LED light emitting portions being evenly disposed on the LED strip light, wherein the plurality of LED light emitting portions are correspondingly arranged on respective bumps, remaining portions of the LED strip light are evenly disposed in respective grooves, an arrangement of the LED light emitting portions is changed from a linear arrangement to an annular arrangement, and the LED light emitting portions are arranged toward a same predetermined direction.

2. The LED ring lamp structure according to claim 1, wherein the annular base is a rectangular thin plate having a plurality of trapezoid patterns, an upper base and a lower base of each of the trapezoid patterns are disposed at both long sides of the rectangular thin plate, respectively, the rectangular thin plate is folded along respective trapezoid patterns to form the plurality of bumps and the plurality of grooves, the rectangular thin plate is connected end-to-end to form as a ring shape, and a total length of an inner edge line of the annular base is equal to a total length of an outer edge line of the annular base.

3. The LED ring lamp structure according to claim 1, further comprising an annular rear cover and an annular front cover, wherein the annular front cover allows light transmission, the annular base is disposed in the annular rear cover, and then the annular front cover covers the annular rear cover.

4. The LED ring lamp structure according to claim 3, wherein the annular rear cover is the annular base.

5. The LED ring lamp structure according to claim 4, further comprising a holder connector, which is disposed at a predetermined position of the annular rear cover and is capable of connecting with a holder.

* * * * *